US007892047B2

(12) United States Patent
Strickland, Jr.

(10) Patent No.: US 7,892,047 B2
(45) Date of Patent: Feb. 22, 2011

(54) SINGLE POLE CABLE CONNECTOR WITH TAMPER RESISTANT LOCKING MECHANISM

(75) Inventor: Carl Craig Strickland, Jr., Kinston, NC (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/112,455

(22) Filed: Apr. 30, 2008

(65) Prior Publication Data

US 2009/0275246 A1 Nov. 5, 2009

(51) Int. Cl.
*H01R 13/42* (2006.01)

(52) U.S. Cl. ..... 439/738

(58) Field of Classification Search ..... 439/738, 439/797, 793, 805, 810, 723, 728, 794; 606/916, 606/270, 308; 411/2
See application file for complete search history.

(56) References Cited

U.S. PATENT DOCUMENTS

| | | | | |
|---|---|---|---|---|
| 3,109,690 | A | 11/1963 | Stevens | |
| 3,143,384 | A | 8/1964 | Senior, Jr. | 439/282 |
| 3,226,667 | A | 12/1965 | Senior, Jr. | 439/282 |
| 3,662,296 | A | 5/1972 | Newman | |
| 3,681,742 | A | 8/1972 | Newman | |
| 3,689,866 | A | 9/1972 | Kelly | |
| 3,784,964 | A | 1/1974 | Newman et al. | 439/603 |
| RE28,877 | E * | 6/1976 | Pertuit | 439/723 |
| 3,963,322 | A * | 6/1976 | Gryctko | 439/814 |
| 4,159,862 | A | 7/1979 | Funck et al. | |
| 4,702,539 | A | 10/1987 | Cusick et al. | 439/588 |
| 5,137,476 | A * | 8/1992 | Noble | 439/797 |
| 5,366,392 | A | 11/1994 | Raloff et al. | 439/889 |
| 6,309,258 | B1 | 10/2001 | Measley | 439/738 |
| 6,726,687 | B2 * | 4/2004 | Jackson | 606/916 |
| 7,077,681 | B2 | 7/2006 | Behoo | 439/333 |
| 7,147,509 | B1 | 12/2006 | Burris et al. | |
| 7,198,507 | B2 | 4/2007 | Tusini | |
| 7,488,224 | B1 | 2/2009 | Strickland, Jr. | |

* cited by examiner

*Primary Examiner*—Edwin A. Leon
(74) *Attorney, Agent, or Firm*—King & Spalding LLP

(57) ABSTRACT

A single pole cable connector includes a tamper-resistant locking system. The locking system includes a locking disk and a corresponding unlocking tool for removing the locking disk from the connector to provide access to the locking mechanism. Single pole cable connector systems include male and female single pole cable connectors in mating engagement. Disengagement of the male and female connectors involves removing the locking disk using the unlocking tool to access and release the locking mechanism.

35 Claims, 17 Drawing Sheets

SINGLE POLE CABLE CONNECTOR WITH TAMPER RESISTANT LOCKING MECHANISM

CROSS-REFERENCE TO RELATED APPLICATIONS

The present application is related to U.S. patent application Ser. No. 11/955,953, titled "Single Pole Cable Connector" and filed on Dec. 13, 2007, in the name of Carl Craig Strickland, Jr., the entire disclosure of which is hereby fully incorporated herein by reference.

TECHNICAL FIELD

The application relates generally to single pole cable connectors having a tamper resistant locking mechanism.

BACKGROUND OF THE INVENTION

Single pole connectors are used to connect two lengths of wire or cable, for example, to provide cable to ships when shored. Known single pole connectors typically use a retention mechanism, such as a spring finger, to secure a circular contact attached to an electrical cable within an insulating sleeve of the connector. However, once the contact is inserted and locked into the insulating sleeve with the spring finger, the assembly becomes permanent and if the insulating sleeve is damaged in service, the complete connector, sleeve, and contact must be replaced. In addition, the design of conventional single pole connectors may allow the circular contact to slip and rotate within the insulator sleeve under certain conditions, thus making it difficult to disengage the contact without cutting the sleeve apart. Furthermore, some conventional insulating sleeves may include a thermoset rubber, such as a neoprene/hypalon rubber compound, as well as a metallic locking ring within the sleeve. As rubber sleeves are prone to abrasion, the current carrying metallic locking ring may be exposed when the sleeve splits or tears, thus potentially creating an unsafe environment for a user.

Some connectors may include a push button unlocking mechanism to allow a user to disconnect a male connector from a female connector. Additionally, some connectors may include a screw or other fastening device to secure the individual components of the connector together. As push button unlocking mechanisms are easily accessible and screws are removable using readily available tools, unauthorized personnel may tamper with and disconnect the connectors.

Therefore, a need exists for an improved single pole connector that can be safely disconnected, while having a locking mechanism that prevents tampering and disconnection by unauthorized personnel.

SUMMARY OF THE INVENTION

The present invention satisfies the above-described need by providing a lock system having a locking disk and an unlocking tool. The locking disk can engage an opening in a connector and prevent access by unauthorized users to a latch mechanism locking a male and female connector together. The locking disk can be removed with the use of the unlocking tool to allow access to the latch mechanism and allow users to disconnect an engaged male and female connector. In certain aspects, the locking disk can be utilized to lock the individual components of the male or female connectors together. The locking disk can be removed with the use of the unlocking tool to allow disconnection of the individual components of the male or female connectors.

The locking disk of the present invention can include a top surface having at least two indentations. In certain aspects, the locking disk can be disk-shaped and include five indentations arranged in a circular configuration about the center of the top surface. In certain aspects, the indentations can be substantially cylindrical in shape. In certain aspects, the locking disk can include a bottom surface opposite the top surface. The bottom surface can include a threaded shank. The locking disk can include a side wall between the top and bottom surfaces that is threaded to mate with a threaded opening of a connector. In certain aspects, the locking disk can be fabricated from a nonconductive material.

The unlocking tool of the present invention can include a top surface and a bottom surface opposite the top surface. At least two protrusions can extend from the bottom surface. The protrusions can be configured to engage the indentations of the locking disk. The top surface can include a protrusion extending out therefrom. The protrusion can be utilized to depress the latch mechanism to unlock the male and female connectors for disconnection when the unlocking tool is inverted so that the protrusion is positioned within the threaded opening of the connector. The protrusion can be hexagonal-shaped and centrally positioned on the top surface. In certain aspects, the unlocking tool can be fabricated from a nonconductive material.

These and other aspects, features and embodiments of the present invention will become apparent to those skilled in the art upon consideration of the following detailed description of illustrated embodiments exemplifying the best mode for carrying out the invention as presently perceived.

BRIEF DESCRIPTION OF THE DRAWINGS

The present invention may be better understood by reading the following description of non-limitative embodiments with reference to the attached drawings wherein like parts of each of the several figures are identified by the same reference characters, and which are briefly described as follows.

DETAILED DESCRIPTION OF THE INVENTION

Figure 1A:
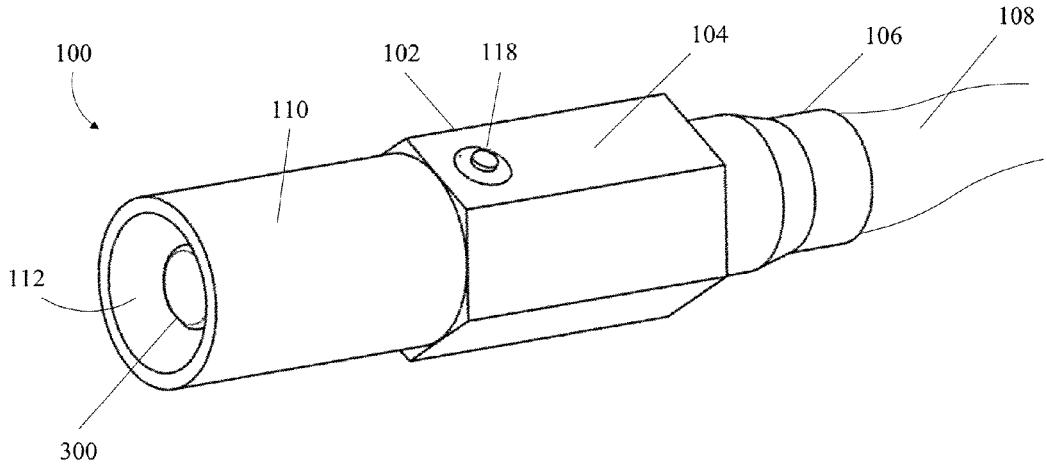
FIG. 1A is a perspective view of an exemplary male connector.

The present application relates to single pole connectors that can be safely disconnected, while having a locking mechanism that prevents tampering and disconnection by unauthorized personnel Referring to FIGS. 1A-1D, a male connector 100 includes an insulating sleeve 102. The insulating sleeve 102 is made from an insulating material, such as thermoplastic material. The sleeve 102 is generally cylindrical but includes a hexagonal-shaped central portion 104. The central portion 104 may be grasped, such as by a wrench, to manipulate the connector 100. While central portion 104 is hexagonal-shaped in the illustrated embodiment, in alternate embodiments, it may be configured to have any number of other shapes so long as sufficient gripping surfaces are provided. The sleeve 102 also includes a tapered end 106 from which an insulated cable 108 extends. The tapered end 106 has a smaller width or diameter than the central portion 104, and may be tapered stepwise or gradually from the central portion 104. The tapered end 106 is positioned on the opposite of central portion 104 as a cylindrical connection portion 110. The connection portion 110 has an open end 112 that permits access to a conductive contact 300 (See FIG. 3) and interacts with a connection portion of, for example, a mating connector or a supply panel to isolate the contact 300 from the external environment. In some embodiments, the connection portion 110 may have a ball nose (not shown), while in other embodiments, the connection portion 110 may have a slight tapered nose (as shown in the Figures). The central portion 104 includes an opening 114 through which a nonconductive screw 116 may be accessed. In some embodiments, the nonconductive screw 116 may be a nylon screw. The screw 116 secures the contact 300 in place within the sleeve 102. The insulating sleeve 102 also includes a release mechanism (or lock release button) 118 and allows for removal of the sleeve 102 and reuse of the male connector 100.

Figure 2A:
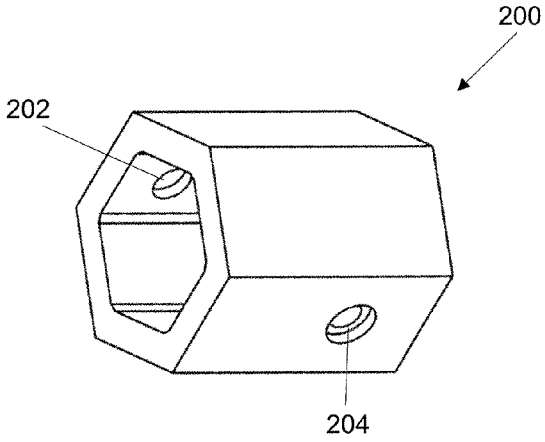
FIG. 2A is a perspective view of an exemplary locking sleeve of the male connector shown in FIG. 1A.
Figure 2B:
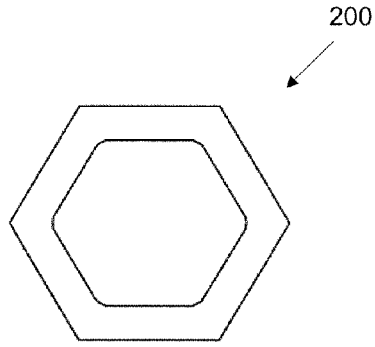
FIG. 2B is a front view of the locking sleeve shown in FIG. 2A.
Figure 2C:
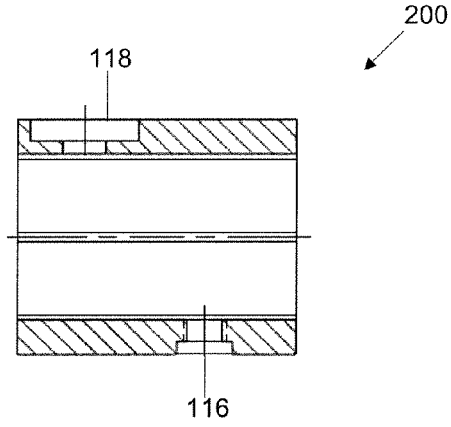
FIG. 2C is a side cross-sectional view of the locking sleeve shown in FIG. 2A.

Referring to FIGS. 2A-2C, the connector 100 contains a hexagonal-shaped locking sleeve (or locking ring) 200 positioned within the sleeve 102 in the region defined by the central portion 104. The locking sleeve 200 defines a central channel sized to receive a contact (not shown). The locking sleeve 200 is nonmetallic and thus provides a safer environment for a user in the instance that the insulating sleeve 102 is compromised. Suitable examples of nonmetallic materials for constructing the locking sleeve 200 include, but are not limited to, polypropylene, glass fibers, and the like. The locking sleeve 200 includes an opening 202 that aligns with opening 114 of sleeve 102, through which nonconductive screw 116 may be accessed. The locking sleeve also includes an opening 204 through which the release mechanism 118 may be accessed.

Figure 3A:
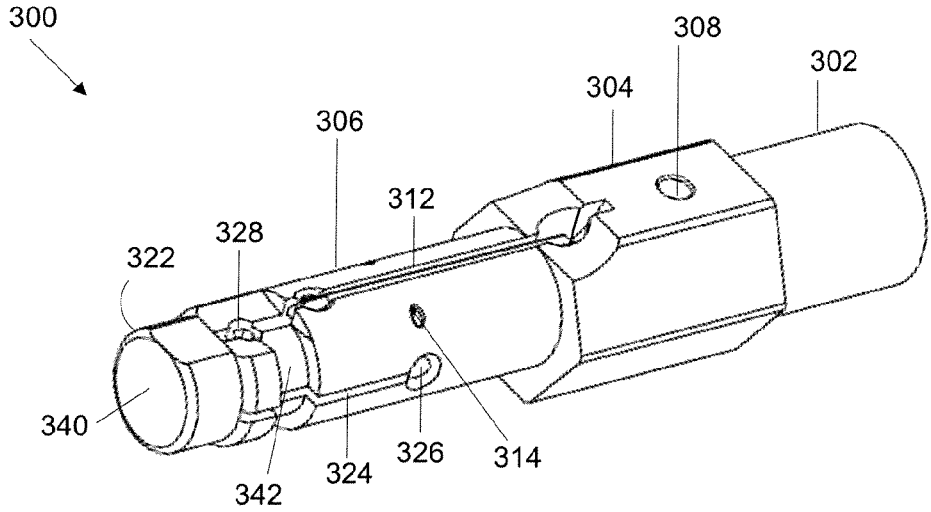
FIG. 3A is a perspective view of an exemplary male contact of the male connector shown in FIG. 1A.
Figure 3B:
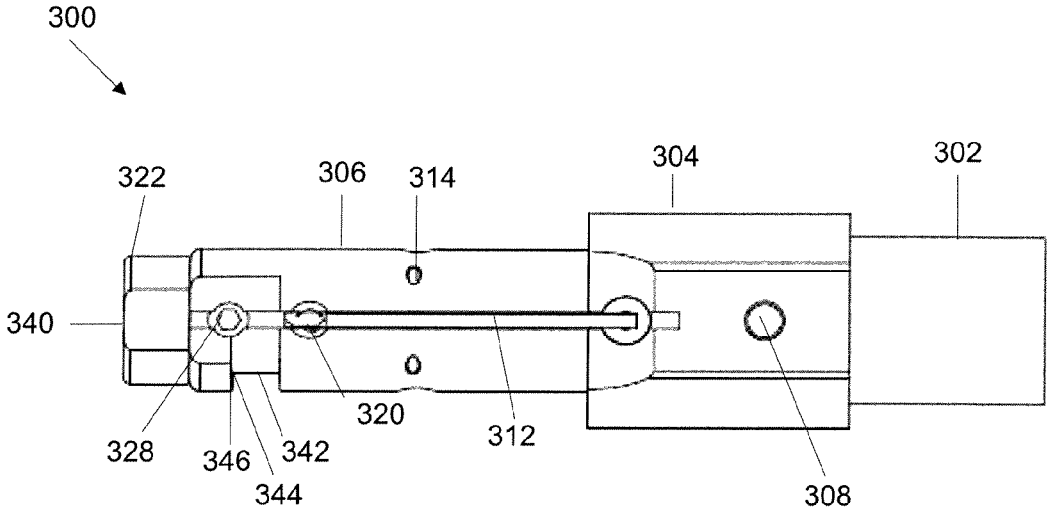
FIG. 3B is a top view of the male contact shown in FIG. 3A.
Figure 3C:
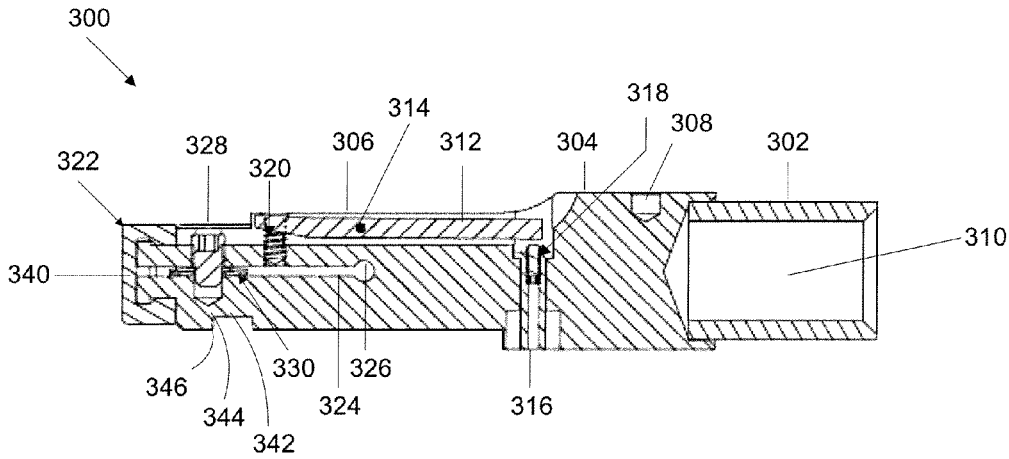
FIG. 3C is a side cross-sectional view of the male contact shown in FIG. 3A.

Referring to FIGS. 3A-3C, an exemplary embodiment of a contact 300 for use with male connector 100 includes a generally cylindrical body 302 having a hexagonal-shaped portion 304 from which extends a generally cylindrical connection portion 306. The hexagonal-shaped portion 304 locks within the locking sleeve 200 and includes a locking hole 308 through which screw 116 is engaged to aid in preventing axial movement of the contact 300 within the connector 100. The hexagonal shape of the portion 304 also locks the contact 300 in place and prevents rotational movement within the connector 100. In alternate embodiments, the portion 304 may be configured in any number of other shapes, so long as the anti-rotational torque is improved over a circular configuration. The body 302 and hexagonal-shaped portion 304 define a channel 310 along most of its length. In use, an electrical cable is positioned in the channel 310 and may be secured in place by crimping or soldering. In other embodiments, the cable may be secured using set screws or other securing implementations. One of skill in the art will recognize alternate means for securing a cable in place. The contact 300 may be made from any conductive material. Suitable examples of conductive materials include, but are not limited to, copper, copper alloys, and brass. In some embodiments, the contact 300 may be plated with silver, silver alloy, nickel, and/or a tarnish resistant treatment.

Contact 300 includes a latch mechanism used in securing the contact 300 into position after engagement and prevents accidental disengagement with a mating contact. The latch mechanism includes a locking latch 312, spirol pin 314, latch plunger pin 316, plunger pin set screw 318, and spring 320. Locking latch 312 is positioned along the length of the connection portion 306 from the hexagonal-shaped portion 304 to just before the tip 322 of the connection portion 306. Spirol pin 314 provides a pivot for the locking latch 312. Locking latch 312 is in contact with plunger pin set screw 318 and latch plunger pin 316 which is in contact with release mechanism 118. At the opposite end of the locking latch 312, the locking latch 312 is in contact with spring 320, which aids in locking the male contact 300 together with a mating contact. Spring 320 provides tension on the latch 312 tip to keep it extended in the locked position, while allowing the latch 312 tip to retract as necessary during the engaging of male and female contacts.

The connection portion 306 has a smaller diameter than the body 302. The connection portion 306 includes a gap (or slot) 324 that extends from the tip 322 of the connection portion 306 to a hole 326 in the connection portion 306. When adjusted by set screw 328, disk spring 330 provides a resistance to inward flexing of contact members and insures a tight, reliable fit between male and female contacts. The gap 324 allows for expansion or contraction of the diameter of the contact 300 as the set screw 328 is adjusted to give optimal contact with a mating female contact.

Tip 322 of the connection portion 306 is an insulator affixed to the end of the connection portion 306 to minimize the risk of inadvertent contact with an electrically live disengaged contact. The tip 322 is circular with a flattened section 340. The flattened section 340 extends a short distance along the length of the connection portion 306 until it terminates in a circumferential groove 342 that extends partially around the circumference of the connection portion 306. In use, the flattened section 340 permits insertion of the end tip 340 into a similarly-shaped opening in a mating contact. The contacts are then rotated relative to each other until the lip 344 is between the circumferential groove 342 and the tip 322 locks with the corresponding circumferential groove in the mating contact. Thereafter, a front wall 346 of the groove 342 prevents axial movement of the contacts relative to each other.

Figure 4:
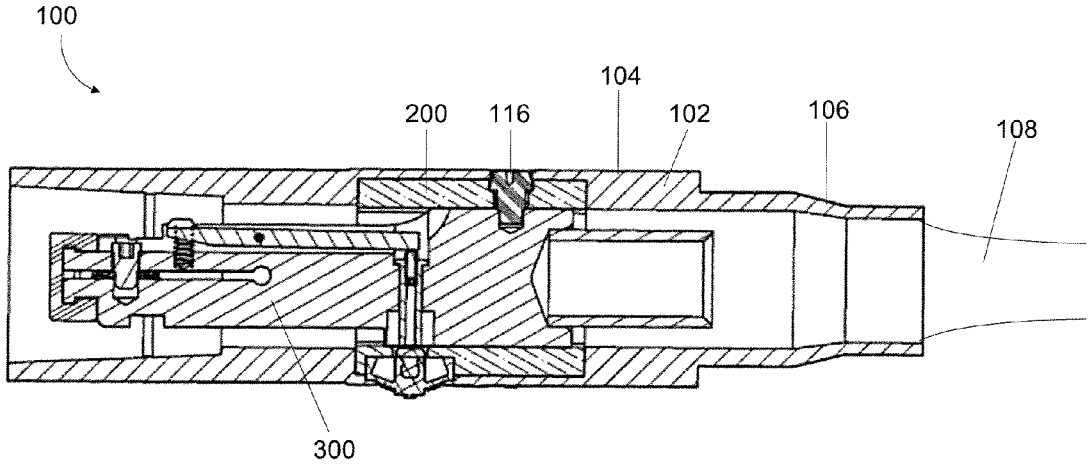
FIG. 4 is a side cross-sectional view of the male connector shown in FIG. 1A.

Referring to FIG. 4, assembly of the male connector 100 begins with insertion of the electrical cable 108 into the tapered end 106 of the insulating sleeve 102 until the cable 108 extends from the end 106. Prior to insertion, the insulation surrounding the conductive elements of the cable 108 must be stripped from the end of the electrical cable 108 to expose the conductive elements. The conductive elements are placed in the channel 310 of the contact 300 and secured via crimping or other mechanism known in the art. Once the contact 300 is attached to the end of the electrical cable 108, the electrical cable 108 is pulled back into the insulating sleeve 102. The contact 300 is pushed into the sleeve 102 such that the locking hole 308 is aligned with openings 114 and 202 of the central portion 104 of insulating sleeve 102 and locking sleeve 200, respectively. The screw 116 is then inserted into openings 114 and 202, and locking hole 308 to lock the contact 300 in place and prevent axial motion of the contact 300 relative to the sleeve 102.

Figure 5A:
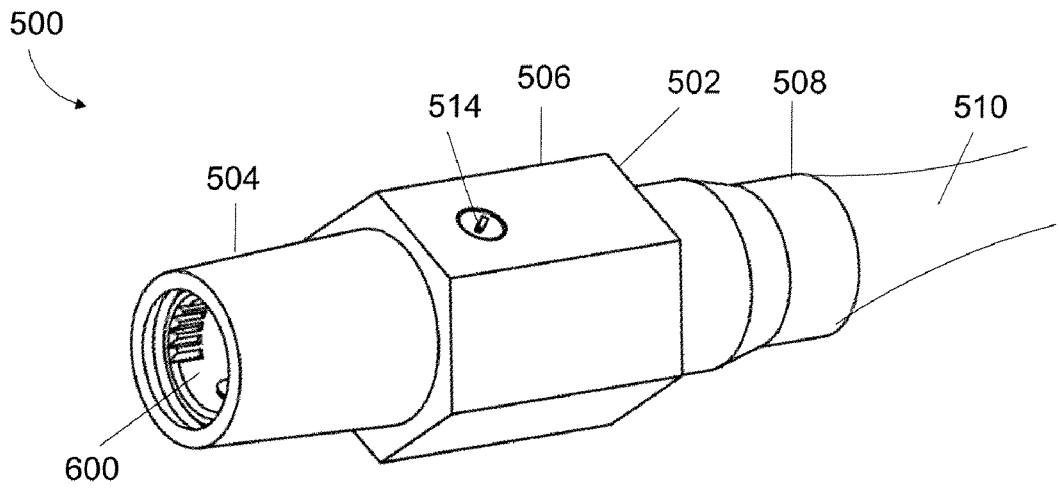
FIG. 5A is a perspective view of an exemplary female connector.
Figure 5B:
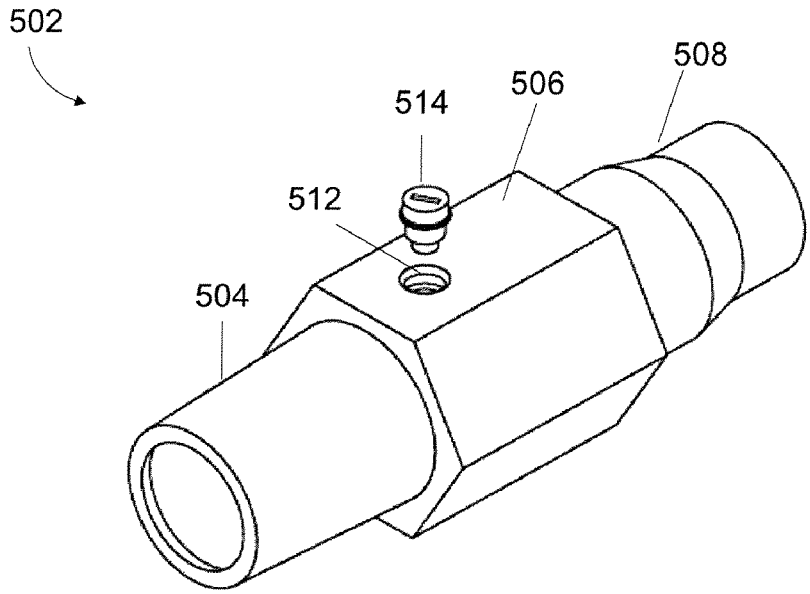
FIG. 5B is a perspective view of an exemplary insulating sleeve of the female connector shown in FIG. 5A.
Figure 5C:
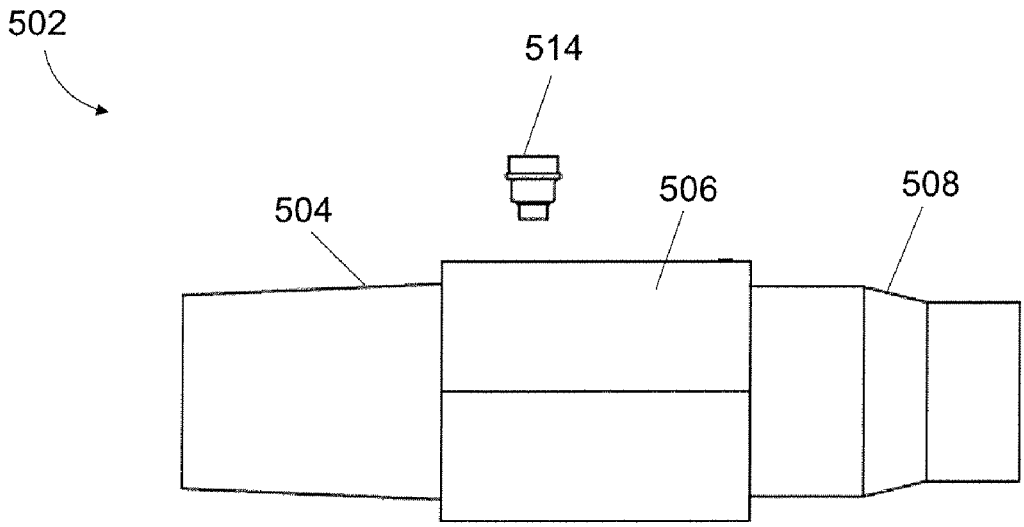
FIG. 5C is a side view of the insulating sleeve shown in FIG. 5B.
Figure 5D:
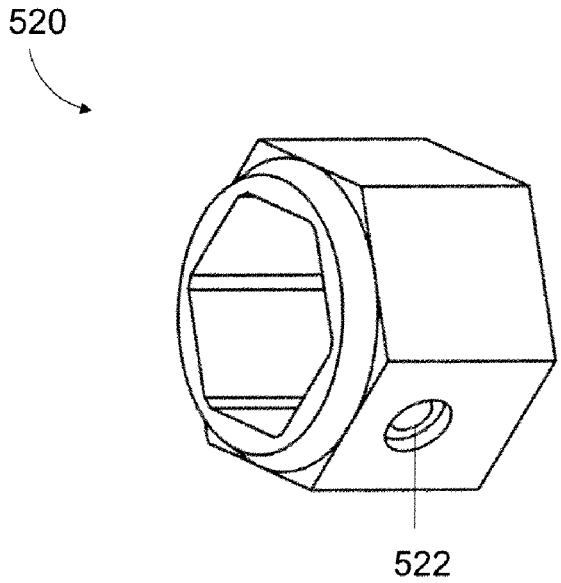
FIG. 5D is a perspective view of an exemplary locking sleeve of the female connector shown in FIG. 5A.

Referring to FIGS. 5A-5C, a female connector 500 for use with the male connector 100 includes an insulating sleeve 502 that is similar in shape and operation to the insulating sleeve 102 of the connector 100. The sleeve 502 differs in that it includes a connection portion 504 that is of smaller diameter than the connection portion 110 of the sleeve 102, and is sized to be received within the connection portion 110. The sleeve 502 also does not include a release mechanism. The sleeve 502 is generally cylindrical and includes a hexagonal-shaped central portion 506. The central portion 506 is grasped to manipulate the connector 500. While central portion 506 is hexagonal-shaped as shown in the figures, in alternate embodiments, the central portion 506 may be configured any number of ways so long as gripping surfaces are provided. The sleeve 502 also includes a tapered end 508 from which an insulated cable 510 extends. The tapered end 508 has a smaller width or diameter than the central portion 506, and may be tapered stepwise or gradually (not shown) from the central portion 506. The tapered end 508 is positioned opposite the cylindrical connection portion 504. The connection portion 504 has an open end that permits access to a conductive contact 600 and interacts with a connection portion of a mating male connector. In some embodiments, the connection portion 504 may have a ball nose (not shown), while in other embodiments, the connection portion 504 may have a tapered nose (shown in the Figures). The central portion 506 includes an opening 512 through which a nonconductive screw 514 may be accessed. In some embodiments, the nonconductive screw 514 may be a nylon screw. The screw 514 secures the contact 600 in place within the sleeve 502. Referring to FIG. 5D, the connector 500 includes a locking sleeve 520 that operates in the same manner as the locking sleeve 200. Locking sleeve 520 includes an opening 522 through which screw 514 may be accessed.

Figure 6A:
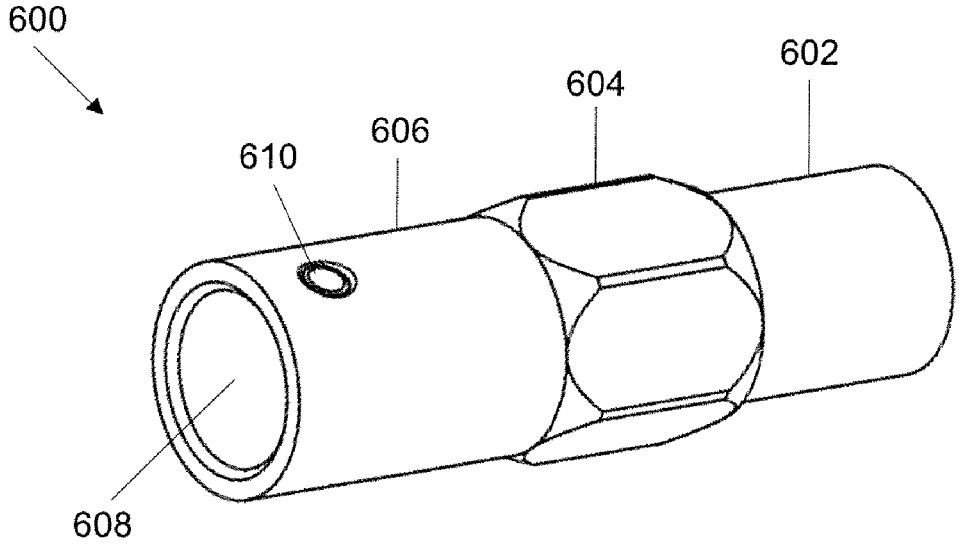
FIG. 6A is a perspective view of an exemplary female contact of the female connector shown in FIG. 5A.
Figure 6B:
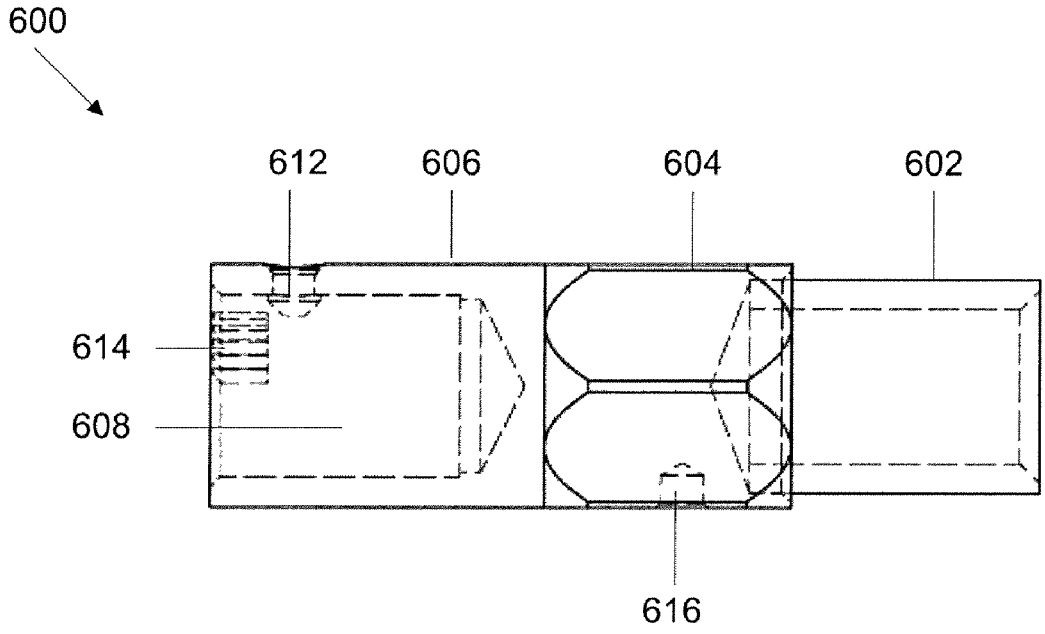
FIG. 6B is a side view of the female contact shown in FIG. 6A.
Figure 6C:
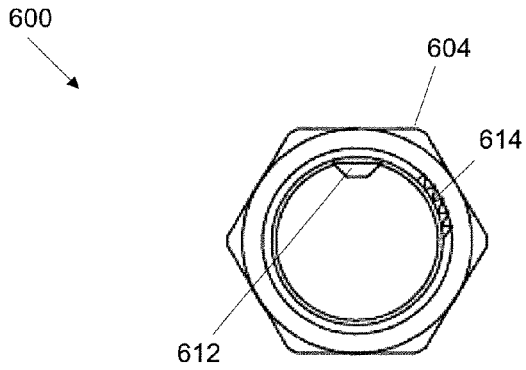
FIG. 6C is a front view of the female contact shown in FIG. 6A.

Referring to FIGS. 6A-6C, contact 600 of the connector 500 is configured similarly to contact 300 of the connector 100. Contact 600 includes a generally cylindrical body 602 having a hexagonal-shaped portion 604 from which extends a generally cylindrical connection portion 606. The body 602 and hexagonal-shaped portion 604 are generally physically and functionally similar to body 302 and hexagonal-shaped portion 304, but the contacts differ in that the contact 600 includes a connection portion 606 that is configured differently from connection portion 306. The connection portion 606 is substantially cylindrical and defines a channel 608 that is sized to receive the connection portion 306 of male contact 300. The connection portion 606 includes an opening 610 for a rivet 612 to be accessed and to lock the connection portion 306 of male contact 300 when inserted. The rivet 612 is designed to engage groove 342 of male contact 300. The connection portion 606 also includes slots (or broached teeth) 614 to aid in securing the male contact 300 in place. The latch mechanism of contact 300 engages one of the slots 614 and locks the male contact 300 and female contact 600 together and prevents accidental disengagement. In an exemplary embodiment, the contact 300 may include five slots 614. Hexagonal-shaped portion 604 includes a locking hole 616 to receive screw 514. While the illustrated portion 604 is hexagonal-shaped, in alternate embodiments, the portion 604 may be configured in any number of other shapes, so long as the anti-rotational torque is improved over a circular configuration.

Figure 7:
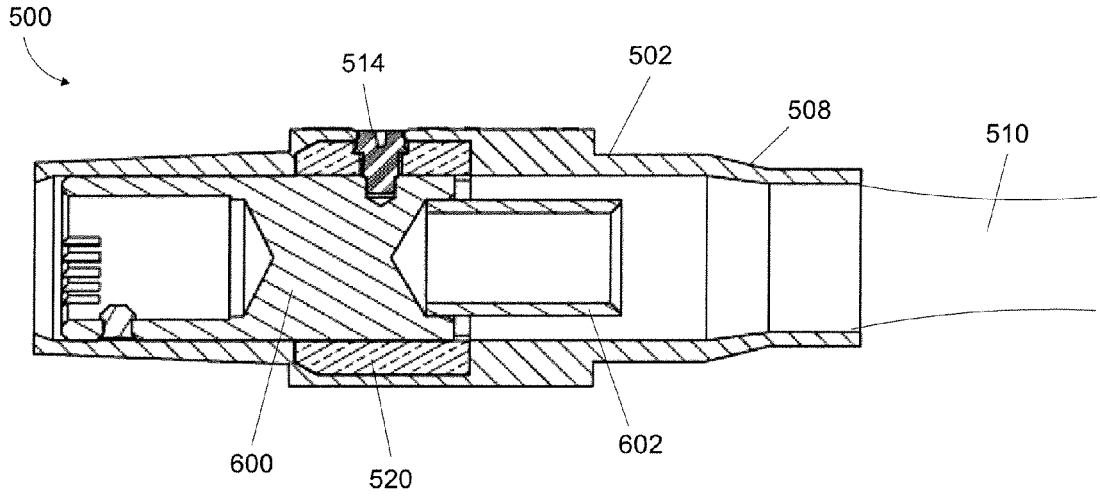
FIG. 7 is a side cross-sectional view of the female connector shown in FIG. 5A.

Referring to FIG. 7, assembly of the female connector 500 begins with insertion of the electrical cable 510 into the tapered end 508 of the insulating sleeve 502 until the cable 510 extends from the end 508. Prior to insertion, the insulation surrounding the conductive elements of the cable 510 must be stripped from the end of the electrical cable 510 to expose the conductive elements. The conductive elements are placed in the channel defined by body 602 of contact 600 and secured via crimping or other mechanism known in the art. Once the contact 600 is attached to the end of the electrical cable 510, the electrical cable 510 is pulled back into the insulating sleeve 502. The contact 600 is pushed into the sleeve 502 such that the locking hole 616 of the contact 600 is aligned with openings 512 and 522 of the central portion 506 of insulating sleeve 502 and locking sleeve 520, respectively. The screw 514 is then inserted into openings 512 and 522, and locking hole 616 to lock the contact 600 in place and prevent axial motion of the contact 600 relative to the sleeve 502.

Figure 8A:
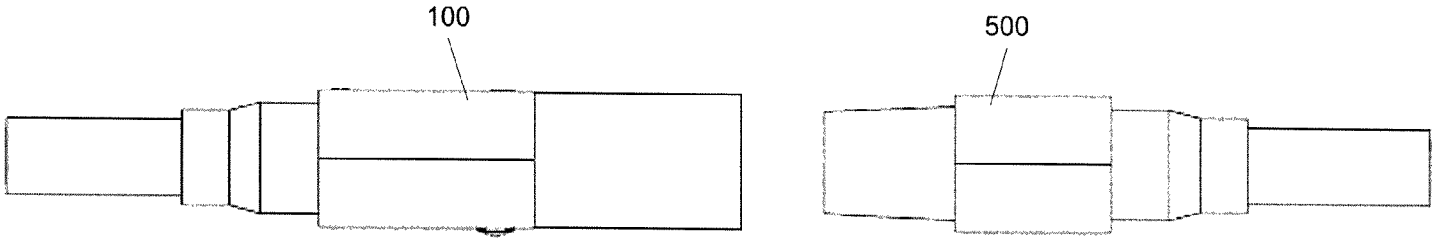
FIG. 8A is a side view of the male connector shown in FIG. 1A and the female connector shown in FIG. 5A disengaged.
Figure 8B:
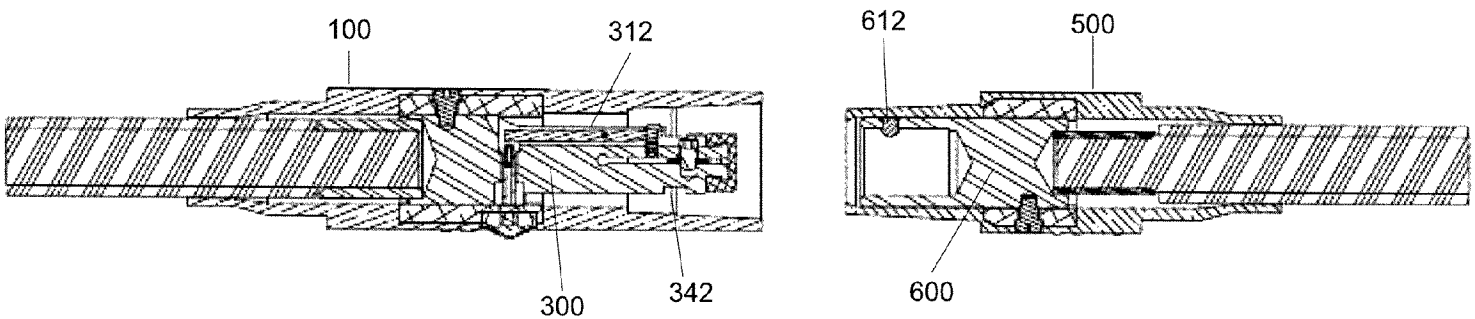
FIG. 8B is a side cross-sectional view of the male connector shown in FIG. 1A and the female connector shown in FIG. 5A disengaged.
Figure 8C:
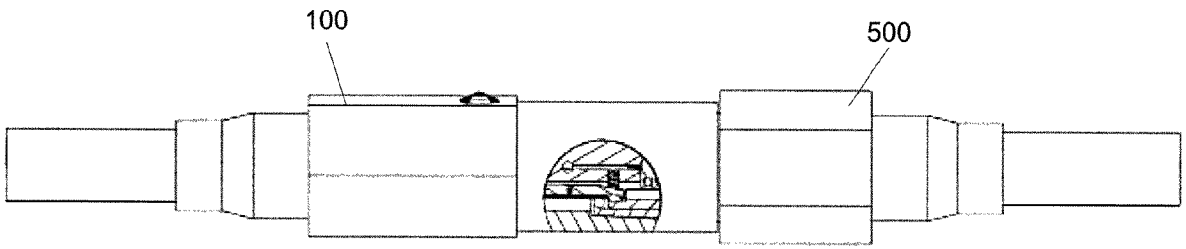
FIG. 8C is a side view of the male connector shown in FIG. 1A and the female connector shown in FIG. 5A engaged, with a portion being a cross-sectional view illustrating the internal engagement.

FIGS. 8A-8C illustrate engagement of male connector 100 and female connector 500. Male contact 300 is placed in female contact 600 and then rotated such that rivet 612 of female contact 600 locks with the circumferential groove 342 that extends partially around the circumference of the connection portion 306 of male contact 300. Additionally, the locking latch 312 of contact 300 engages one of the slots 614 of female contact 600 and further locks the male contact 300 and female contact 600 together.

Figure 9A:
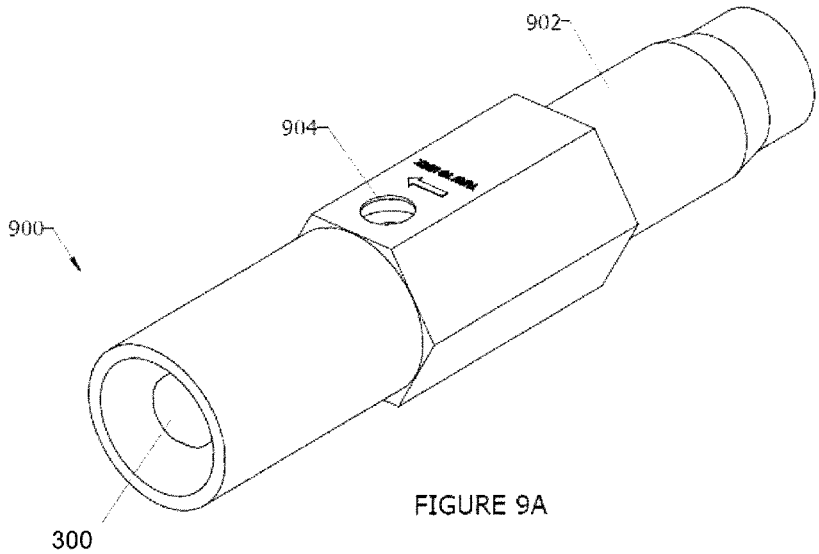
FIG. 9A is a perspective view of a male connector according to an alternative exemplary embodiment.
Figure 9B:
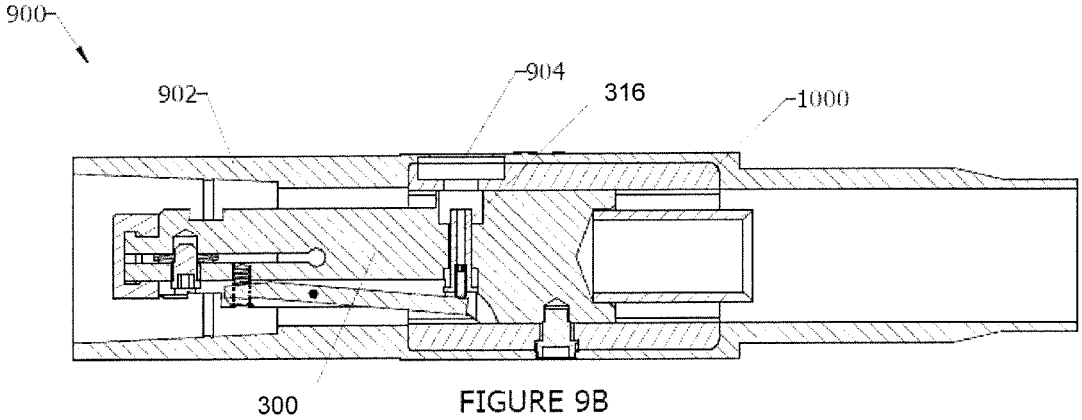
FIG. 9B is a side cross-sectional view of the male connector shown in FIG. 9A.

FIGS. 9A-9B illustrate a male connector 900 according to an alternative exemplary embodiment. The male connector 900 includes an insulating sleeve 902 similar to the insulating sleeve 102 of male connector 100, the difference being that the insulating sleeve 902 includes a circular opening 904 in place of the lock release button 118. The opening 904 is configured to at least partially receive a locking disk 1100 (FIG. 11) therein and prevent access to the latch plunger pin 316 of contact 300, as described with reference to FIG. 3C. In certain embodiments, the interior surface of the opening 904 is smooth. In certain exemplary embodiments, a bottom of the interior surface of the opening 904 may include a groove or other configuration (not shown) to accommodate an o-ring or other moisture sealing mechanism. In alternative embodiments, a portion of the interior surface of the opening 904 may be threaded (not shown) to matingly engage a portion of the locking disk 1100.

Figure 10:
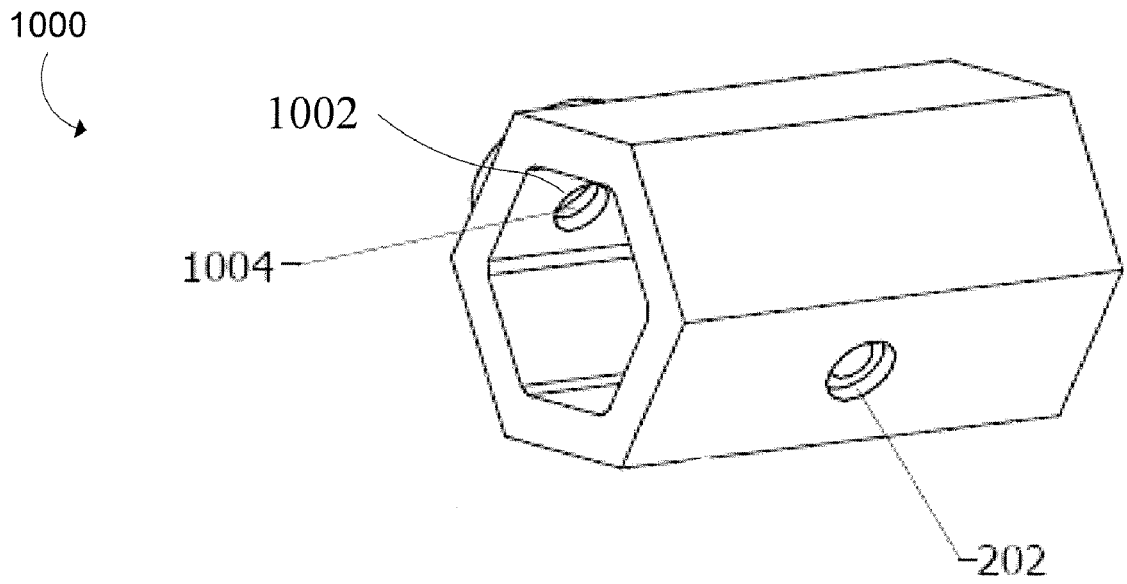
FIG. 10 is a perspective view of a locking sleeve according to an alternative exemplary embodiment.

FIG. 10 illustrates a locking sleeve 1000. The locking sleeve 1000 is configured to be used in conjunction with and positioned within the insulating sleeve 902 of the male connector 900. The locking sleeve 1000 is similar to the locking sleeve 200, the difference being that the locking sleeve 1000 includes an opening 1002 in place of the opening 204. Once the male connector 900 is assembled, the opening 1002 aligns with the opening 904 of the insulating sleeve 902. The opening 1002 is configured to at least partially receive the locking disk 1100 (FIG. 11) therein. In certain exemplary embodiments, the opening 1002 includes threading 1004 for engaging the locking disk 1100.

FIGS. 11A-11D illustrate alternate views of a locking disk 1100. The locking disk 1100 may be used in conjunction with male connector 900 to prevent tampering of the male connector 900 by a user and accidental unlocking when the male connector 900 is connected to female connector 500. The locking disk 1100 is fabricated from any nonconductive material. In certain exemplary embodiments, the locking disk 1100 is fabricated from a hard plastic.

Figure 11A:
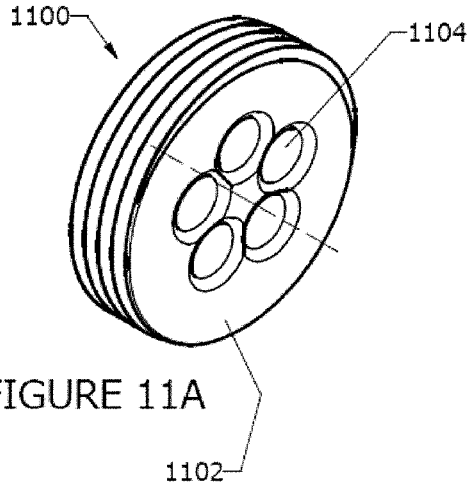
FIG. 11A is a top perspective view of a locking disk according to an exemplary embodiment.
Figure 11B:
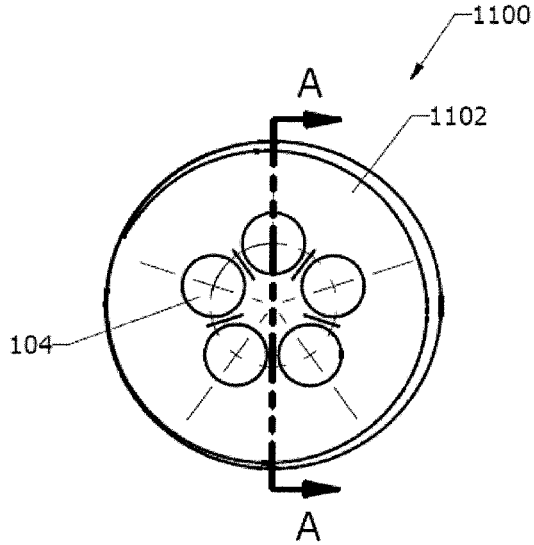
FIG. 11B is a top view of the locking disk shown in FIG. 11A.

FIGS. 11A-11B are perspective and top views of the locking disk 1100. Locking disk 1100 comprises a top surface 1102. The top surface 1102 comprises a plurality of indentations or apertures 1104. In certain exemplary embodiments, the top surface 1102 comprises five apertures 1104 positioned in a circular configuration. One having ordinary skill in the art with the benefit of this disclosure will recognize that the apertures 1104 may be configured in any pattern that may preclude its operation by commonly available tools and keys. In alternative embodiments, any number of apertures 1104 may be included in any configuration as limited by the size of the top surface 1102. While circular apertures 1104 are shown in the figures, one having ordinary skill in the art will recognize that apertures 1104 may be any shape, including, but not limited to, a square, triangle, ellipse, rectangle, or any other suitable shape. In certain embodiments, the top surface 1102 may include a number of apertures 1104 having varying shapes.

Figure 11C:
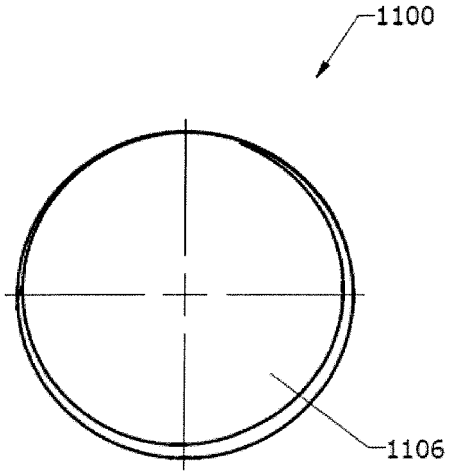
FIG. 11C is a bottom view of the locking disk shown in FIG. 11A.

FIG. 11C is a bottom view of the locking disk 1100. Locking disk 1100 includes a bottom surface 1106. In certain exemplary embodiments, the bottom surface 1106 is a solid flat surface. The bottom surface 1106 prevents access to the latch plunger pin 316 of the contact 300 in male connector 900.

Figure 11D:
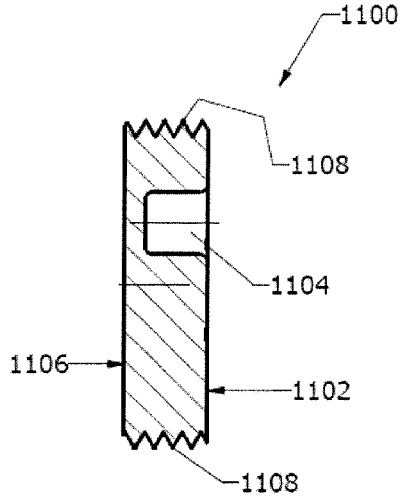
FIG. 11D is a side cross-sectional view of the locking disk taken along section A-A of FIG. 11B.

FIG. 11D is a side cross-sectional view of the locking disk 1100 taken along section A-A of FIG. 11B, illustrating the top surface 1102, one of the apertures 1104, and the bottom surface 1106. The locking disk 1100 also includes threading 1108 for mating with threading 1004 of the opening 1002 in the locking sleeve 1000. In certain embodiments, a portion of the threading 1108 may also mate with threading, if present, in the opening 904 of the insulating sleeve 902.

FIGS. 12A-12D illustrate alternate views of an unlocking tool 1200. The unlocking tool 1200 is configured to be used in conjunction with the locking disk 1100. The unlocking tool 1200 is fabricated from any nonconductive material. In certain exemplary embodiments, at least a portion of the unlocking tool 1200 comprises a hard plastic.

Figure 12A:
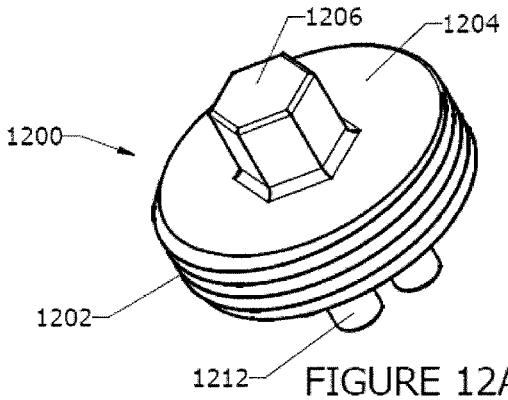
FIG. 12A is a top perspective view of an unlocking tool according to an exemplary embodiment.
Figure 12B:
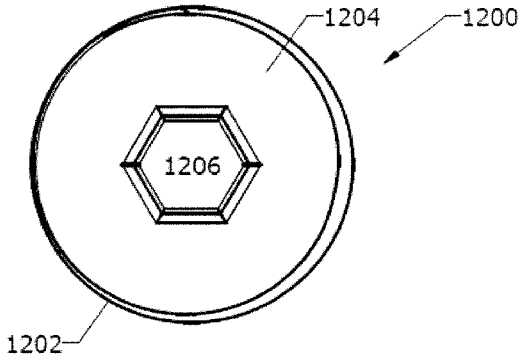
FIG. 12B is a top view of the unlocking tool shown in FIG. 12A.

FIGS. 12A-12B are top perspective and top views of the unlocking tool 1200. The unlocking tool 1200 includes a central portion 1202 having a top surface 1204. In certain exemplary embodiments, the central portion 1202 is threaded. In certain embodiment, the central portion 1202 has a smooth surface (not shown). The unlocking tool 1200 also includes a protrusion 1206 positioned in the center of the top surface 1204 and extending outwardly therefrom. In certain exemplary embodiments, the protrusion 1206 is hexagonally-shaped. However, one having ordinary skill in the art with the benefit of this disclosure will recognize that the protrusion 1206 may be any shape and any length, so long as it is capable of contacting and depressing the latch plunger pin 316 when the unlocking tool 1200 is threadably inserted into the opening 1002 of the locking sleeve 1000 of male connector 900, as described with reference to FIGS. 9A, 9B, and 10.

Figure 12C:
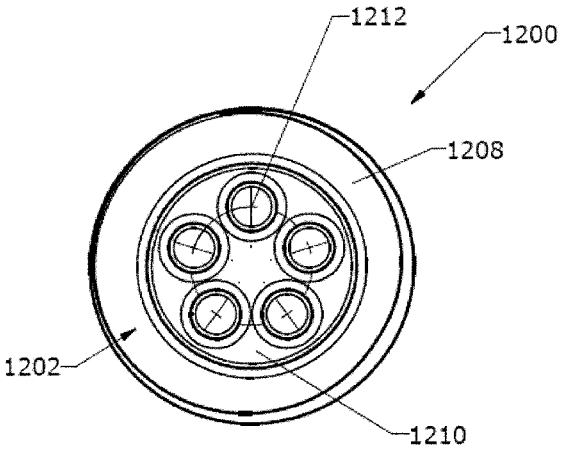
FIG. 12C is a bottom view of the unlocking tool shown in FIG. 12A.
Figure 12D:
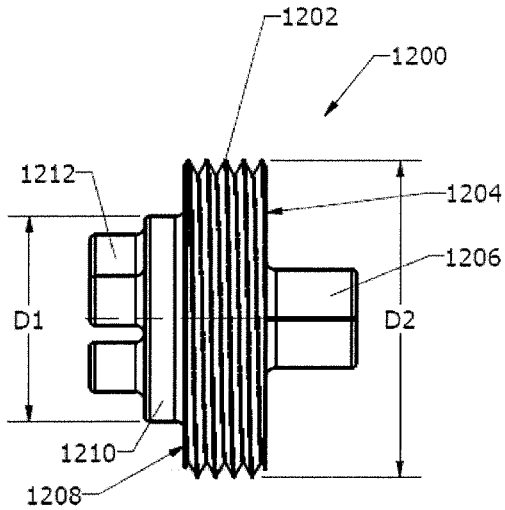
FIG. 12D is a side view of the unlocking tool shown in FIG. 12A.

FIGS. 12C-12D are bottom and side views of the unlocking tool 1200. The central portion 1202 of the unlocking tool 1200 further includes a bottom surface 1208. In certain exemplary embodiments, the unlocking tool 1200 includes a cylindrical extension 1210 extending outwardly from the bottom surface 1208. The cylindrical extension 1210 has a diameter D1 that is less than a diameter D2 of the central portion 1202. In alternative embodiments, the cylindrical extension 1210 may not be present.

The unlocking tool 1200 also includes multiple protrusions 1212 extending from the cylindrical extension 1210, or alternatively, the bottom surface 1208. The protrusions 1212 are configured to correspondingly engage the apertures 1104 (of FIG. 11A) so as to provide a "lock-and-key" system with the locking disk 1100. In certain exemplary, embodiments, the protrusions 1212 are cylindrical extensions. However, one having ordinary skill in the art with the benefit of this disclosure will recognize that each of the protrusions 1212 can have any shape as long as they correspond to the shape(s) of the apertures 1104 of the locking disk 1100.

Figure 13:
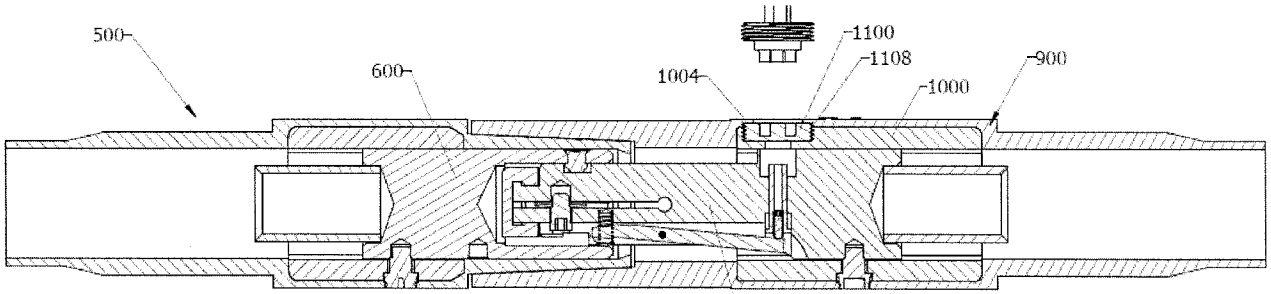
FIG. 13 is a side cross-sectional view of the male connector shown in FIG. 9A and the female connector shown in FIG. 5A engaged with the locking disk of FIG. 11A present.

FIG. 13 is a cross-sectional view of male connector 900 connected to female connector 500 and locked by mating the threading 1108 of the locking disk 1100 to the threading 1004 of the locking sleeve 1000. Male contact 300 connects and locks with female contact 600. The locking disk 1100 prevents a user from accidentally unlocking and disconnecting the male connector 900 from the female connector 500 by preventing access to the latch plunger pin 316.

Figure 14:
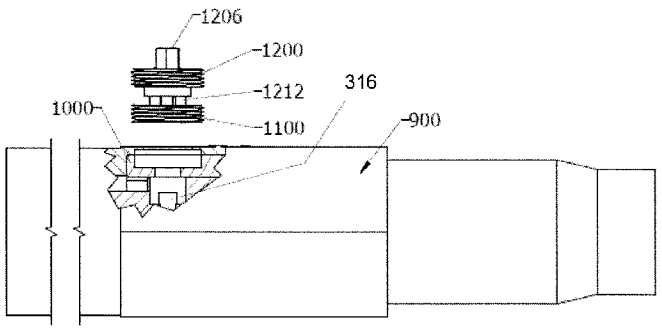
FIG. 14 is a side cross-sectional view illustrating removal of the locking disk shown in FIG. 11A from the engaged male and female connector shown in FIG. 13 using the unlocking tool shown in FIG. 12A.

FIG. 14 illustrates the unlocking tool 1200 removing the locking disk 1100 from the male connector 900 to allow access to the latch plunger pin 316. The protrusions 1212 of the unlocking tool 1200 engage the corresponding apertures 1104 of the locking disk 1100. The unlocking tool 1200 is rotated to unthread the locking disk 1100 from the locking sleeve 1000. In certain exemplary embodiments, the unlocking tool 1200 is rotated using a wrench (not shown) on the protrusion 1206. Once the locking disk 1100 is removed from the locking sleeve 1000, the latch plunger pin 316 is accessible to the user.

Figure 15:
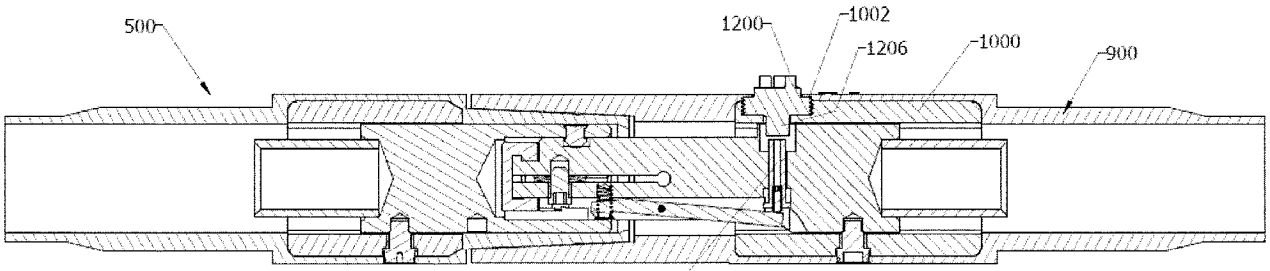
FIG. 15 is a side cross-sectional view illustrating unlocking of the engaged male and female connector shown in FIG. 13 using the unlocking tool shown in FIG. 12A.

FIG. 15 illustrates the unlocking tool 1200 unlocking the male connector 900 from the female connector 500. Once the locking disk 1100 is removed, the unlocking tool 1200 is inverted and the protrusion 1206 of the unlocking tool 1200 is placed into the opening 1002 of the locking sleeve 1000. The protrusion 1206 depresses the latch plunger pin 316, which unlocks the male connector 900 and female connector 500 and allows a user to disconnect the two connector parts.

Figure 16A:
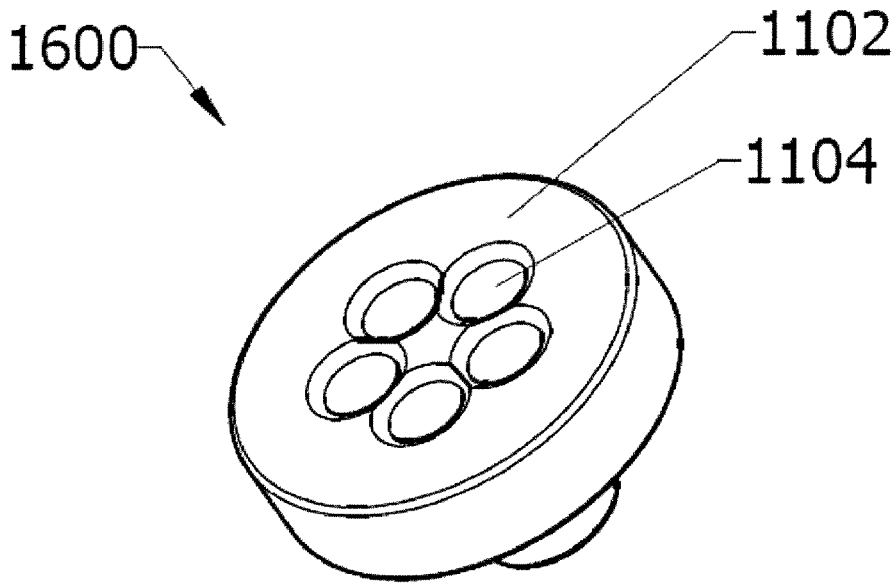
FIG. 16A is a top perspective view illustrating a locking disk according to an alternative exemplary embodiment.
Figure 16B:
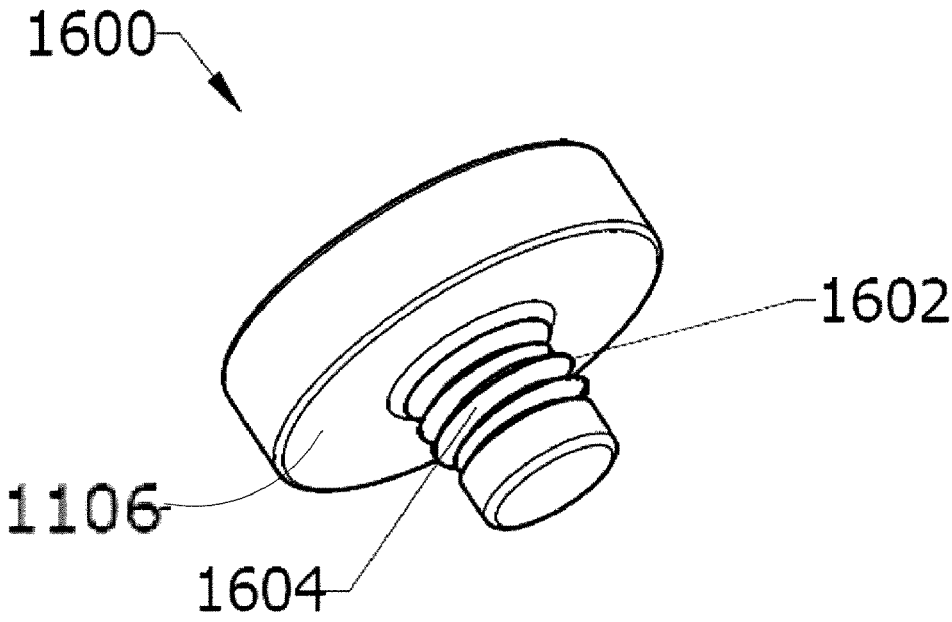
FIG. 16B is a bottom perspective view of the locking disk shown in FIG. 16A.

FIGS. 16A-16B are top perspective and bottom perspective views of a locking disk 1600 according to an alternative exemplary embodiment. The locking disk 1600 is similar to the locking disk 1100 and includes top surface 1102 having apertures 1104, with the difference being that locking disk 1600 further comprises a shank 1602 protruding from the bottom surface 1106. In certain embodiments, the shank 1602 comprises threads 1604. In certain embodiments, the shank 1602 has a substantially constant diameter.

Figure 17:
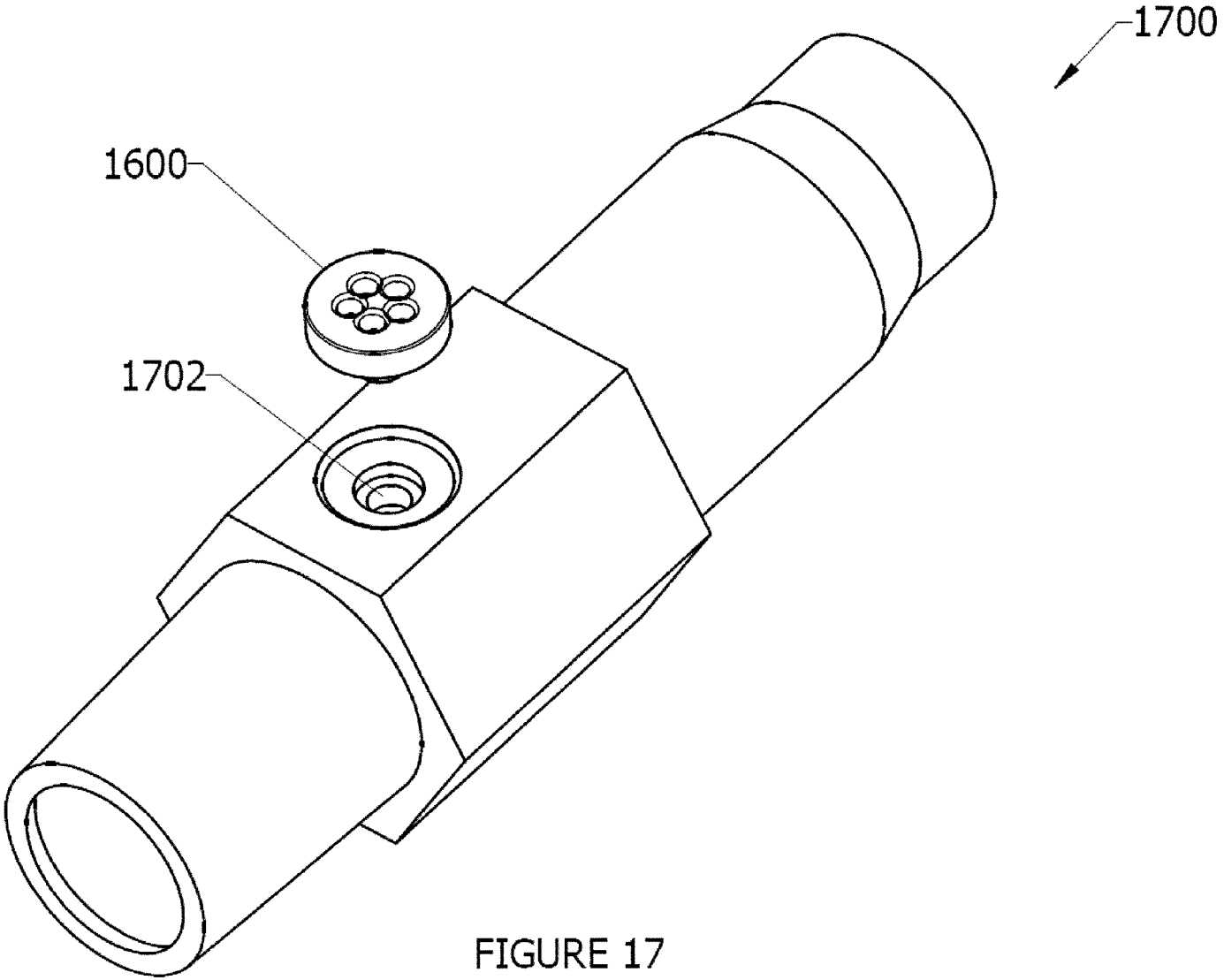
FIG. 17 is a perspective view of a female connector according to an alternative exemplary embodiment and configured to be used in conjunction with the locking disk shown in FIG. 16A.

FIG. 17 is a perspective view of a female connector 1700 according to an alternative exemplary embodiment. The female connector 1700 is similar to female connector 500, the difference being that female connector 1700 includes an opening 1702 in place of opening 512. The opening 1702 is configured to receive the locking disk 1600 similar to how opening 512 of female connector 500 receives screw 514 to lock the components of female connector 500 together. In certain embodiments, the opening 1702 is threaded and the locking disk 1600 is screwed into place. The locking disk 1600 may be inserted and removed using the unlocking tool 1200, as described with respect to FIG. 14.

Figure 1B:
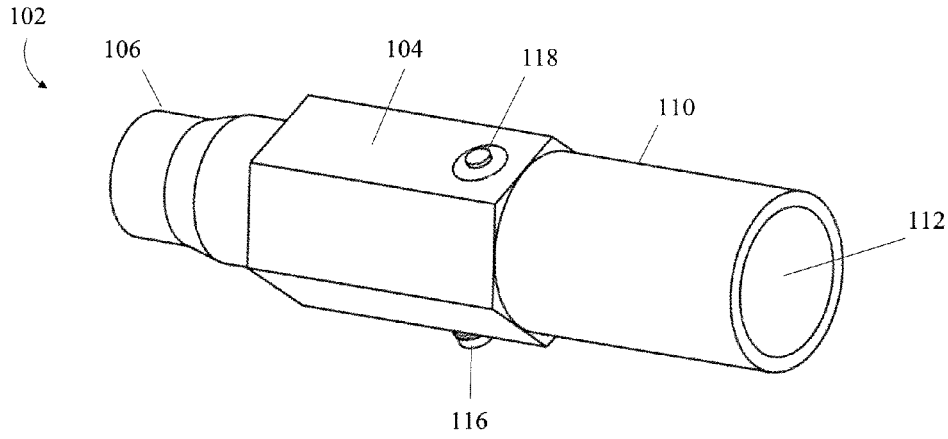
FIG. 1B is a perspective view of an exemplary insulating sleeve of the male connector shown in FIG. 1A.
Figure 1C:
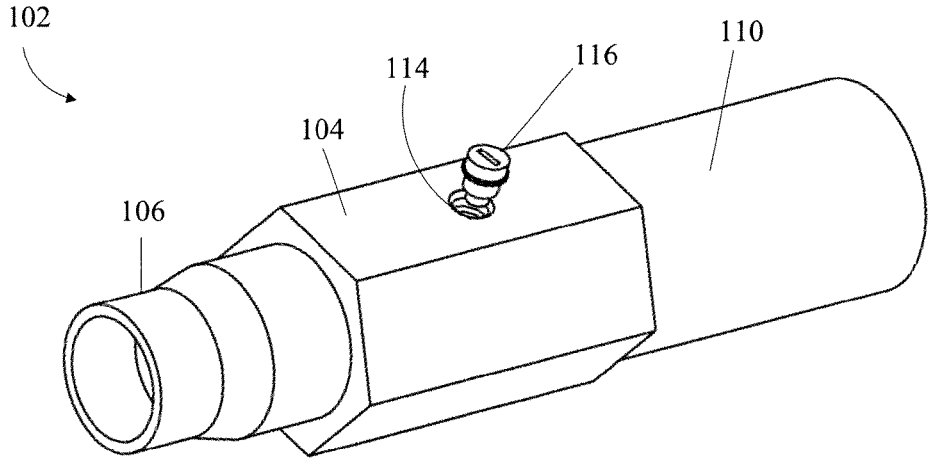
FIG. 1C is an alternate perspective view of the insulating sleeve shown in FIG. 1B.
Figure 1D:
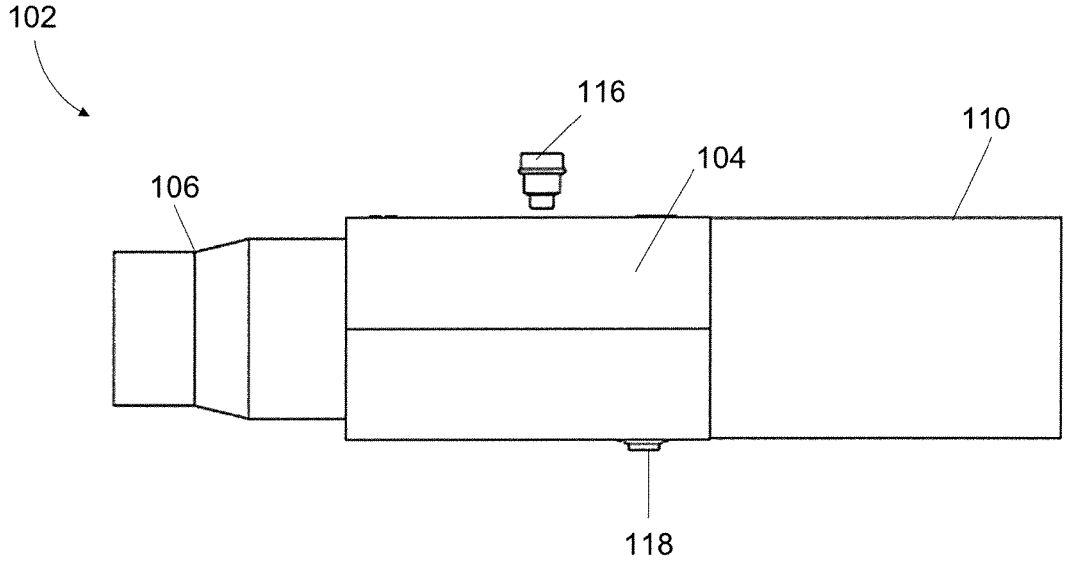
FIG. 1D is a side view of the insulating sleeve shown in FIG. 1B.

One having ordinary skill in the art with the benefit of this disclosure will recognize that male connectors 100, 900 may be modified to be used in conjunction with locking disk 1600 in place of screw 116 (of FIGS. 1B-1D).

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Having described some exemplary embodiments of the present invention, it is believed that the use of the locking disk and unlocking tool with alternate contact configurations for mating contact engagement is within the purview of those in the art. Additionally, while the present application discusses hexagonal-shaped contacts, locking sleeves, and insulating sleeves, it is understood that a number of other non-circular configurations may be used based on the anti-rotational torque desired. Also, while the present application discusses locking disks having five cylindrical apertures in a circular configuration and a corresponding unlocking tool having five cylindrical protrusions in a circular configuration, it is understood that a number of other configurations having an alternate shape and number of apertures and protrusions having a variety of shapes and configurations may be used based on the complexity of the locking system desired. Additionally, for connectors excluding a locking sleeve, the locking disk may be positioned in and engage an opening in the insulating sleeve.

While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A connector, comprising:

an insulating sleeve defining an inner channel, the insulating sleeve comprising a first opening;

a locking sleeve positioned in the insulating sleeve and defining a portion of the inner channel, the locking sleeve comprising a second opening aligned with the first opening;

a locking disk rotatably coupled to the second opening, the locking disk comprising:

a first surface comprising at least two indentations;

a second surface opposite the first surface, wherein the second surface is a solid flat surface; and a side wall disposed between the first and second surface; and a contact positioned within the inner channel.

2. The connector of claim 1, wherein the first surface of the locking disk comprises five indentations disposed in a substantially circular pattern about the center of the first surface.

3. The connector of claim 1, wherein side wall of the locking disk comprises threads, and wherein the second opening comprises mating threads for rotatably coupling the locking disk to the second opening.

4. The connector of claim 1, wherein the second surface of the locking disk comprises a shank extending out from the second surface, wherein the shank comprises threads disposed about at least a portion of an exterior of the shank.

5. The connector of claim 1, wherein the locking disk comprises a nonconductive material.

6. The connector of claim 1, wherein the aligned first and second openings provide access to a latch mechanism for disengaging the contact from a mating contact.

7. The connector of claim 1, wherein at least a portion of the inner channel comprises a non-circular cross-section.

8. The connector of claim 7, wherein the portion of the inner channel having a non-circular cross-section and at least a portion of the contact comprise hexagonal cross-sections.

9. A connector, comprising:

an insulating sleeve comprising an opening and defining an inner channel;

a locking disk positioned in the opening, the locking disk comprising:

a first surface comprising at least two indentations;

a second surface opposite the first surface, wherein the second surface is a solid flat surface; and a side wall disposed between the first and second surface, wherein the side wall comprises threads configured to rotatably couple the locking disk; and a contact positioned within the inner channel.

10. The connector of claim 9, wherein at least a portion of the inner channel comprises a non-circular cross-section.

11. The connector of claim 9, wherein the first surface of the locking disk comprises five substantially cylindrically-shaped indentations disposed about a center of the first surface.

12. The connector of claim 9, wherein the opening comprises mating threads for rotatably coupling the locking disk to the opening.

13. The connector of claim 9, wherein the locking disk comprises a shank extending out from the second surface, wherein at least a portion of an exterior of the shank comprises threads.

14. The connector of claim 9, wherein the locking disk comprises a nonconductive material.

15. The connector of claim 9, wherein the opening provides access to a latch mechanism for disengaging the contact from a mating contact.

16. A connector, comprising:

an insulating sleeve defining an inner channel, the insulating sleeve comprising a first opening;

a locking disk positioned at least partially disposed in the first opening, the locking disk comprising:

a first surface comprising at least two indentations;

a second surface opposite the first surface, wherein the second surface is a solid flat surface; and a side wall disposed between the first and second surface; and a contact positioned within the inner channel.

17. The connector of claim 16, wherein the second surface further comprises a shank protruding therefrom, wherein the shank comprises threads disposed about at least a portion of an exterior of the shank.

18. The connector of claim 16, wherein the locking disk comprises five indentations on the first surface.

19. The connector of claim 16, wherein at least a portion of each indentation comprises a cylindrical recess.

20. The connector of claim 16, wherein the side wall comprises threads configured to rotatably couple the locking disk.

21. The connector of claim 16, wherein the first surface of the locking disk comprises five indentations disposed in a substantially circular pattern about the center of the first surface.

22. The connector of claim 16, wherein the locking disk comprises a nonconductive material.

23. The connector of claim 16, further comprising an unlocking tool comprising a top surface and a bottom surface opposite the top surface, wherein the bottom surface comprises at least two protrusions extending out from the bottom surface and configured to engage with the at least two indentations on the first surface of the locking disk.

24. The connector of claim 23, wherein the unlocking tool further comprises a nonconductive material.

25. The connector of claim 23, wherein the unlocking tool further comprises a raised surface positioned between the bottom surface and the at least two protrusions, wherein a perimeter of the raised surface is less than a perimeter of the top surface.

26. The connector of claim 23, wherein each protrusion is substantially cylindrical.

27. The connector of claim 23, wherein the top surface further comprises a protrusion extending substantially orthogonal from the top surface.

28. The connector of claim 27, wherein at least a portion of the protrusion on a plane substantially parallel to the top surface is hexagonal-shaped.

29. The connector of claim 27, wherein the protrusion is centrally positioned on the top surface.

30. The connector of claim 23, the unlocking tool comprises five protrusions on the bottom surface.

31. The connector of claim 30, wherein the five protrusions are arranged in a substantially circular configuration about the center of the bottom surface.

32. The connector of claim 16, further comprising a locking sleeve disposed in the insulating sleeve and defining a portion of the inner channel, the locking sleeve comprising a second opening aligned with the first opening, the locking disk rotatably coupled to and at least partially disposed in the second opening.

33. The connector of claim 32, wherein the aligned first and second openings provide access to a latch mechanism for disengaging the contact from a mating contact.

34. The connector of claim 16, wherein at least a portion of the inner channel comprises a non-circular cross-section.

35. The connector of claim 34, wherein the portion of the inner channel having a non-circular cross-section and at least a portion of the contact comprise hexagonal cross-sections.

* * * * *